United States Patent [19]

Naka et al.

[11] Patent Number: 5,028,450

[45] Date of Patent: Jul. 2, 1991

[54] METHOD AND APPARATUS FOR COATING A THIN FILM WEB BY USE OF A PLURALITY OF PADS FACING AN ORIFICE

[75] Inventors: Hiroyuki Naka, Osaka; Masato Mitani, Hirakata; Satosi Hirose, Amagasaki, all of Japan

[73] Assignee: Matsushita Electric Industrial Co., Ltd., Kadoma, Japan

[21] Appl. No.: 361,901

[22] Filed: Jun. 6, 1989

[30] Foreign Application Priority Data

Jun. 7, 1988 [JP] Japan ..... 63-140002

[51] Int. Cl.[5] ..... B05D 1/26

[52] U.S. Cl. ..... 427/9; 427/430.1; 118/410; 118/427; 118/428; 118/665

[58] Field of Search ..... 427/430.1, 8, 9, 10; 118/410, 427, 428, 665

[56] References Cited

U.S. PATENT DOCUMENTS

| | | | |
|---|---|---|---|
| 4,090,469 | 5/1978 | Roberts, Jr. | 118/410 |
| 4,176,619 | 12/1979 | Wappling | 118/410 |
| 4,371,571 | 2/1983 | McIntyre et al. | 118/410 X |
| 4,776,997 | 10/1988 | Chino et al. | 427/8 X |

*Primary Examiner*—Shrive Beck
*Assistant Examiner*—Alain Bashore
*Attorney, Agent, or Firm*—Cushman, Darby & Cushman

[57] ABSTRACT

A coater has a die member for discharging a coating material, and a pad member for supporting a web to be fed at a predetermined position and for controlling the gap sensitively to manufacture a coating film. The coater can flow a debris to downstream by moving the pad member away from the web.

7 Claims, 5 Drawing Sheets

METHOD AND APPARATUS FOR COATING A THIN FILM WEB BY USE OF A PLURALITY OF PADS FACING AN ORIFICE

FIELD OF THE INVENTION AND RELATED ART STATEMENT

1. Field of the Invention

The present invention relates to a coater and method for coating thereby, to realize a uniform and thin coating.

2. Description of the Related Art

A thin film coating process, specially that to be used for a magnetic film manufacturing process as a typical example, comprises the step of applying a coating material to a surface of a web-formed thin film. The coating material fed from a process to make the coating material is sent to a coater. At the time the web is fed into the coater to run at a uniform speed, it is coated in the thin film coating process. There are several kinds of coaters used in the process. Typical types of coaters are gravure roll coaters, reverse roll coaters or extrusion die coaters.

In a gravure roll coater, a gravure roll having a roughened surface is rotated to draw the coating material. The coating material is transferred by the roughened surface of the gravure roll to a web. The coating material on the web is then smoothed by a smoother to make a coating of uniform thickness.

In a reverse roll coater, an application roll arranged between a metering roll and a backup roll is used to coat a web uniformly. The three rolls are rotated in the same direction to provide a uniform coating.

In an extrusion die coater, the coating material fed from a supply apparatus is sent through a coating reservoir to the die. The coating material in the coating reservoir is then discharged from an orifice formed in a straight linear shape through a slit connected to the coating reservoir. The web passing by the front of the orifice is run at a uniform speed and in one direction. As a result, the coating material is coated on a surface of the web uniformly.

The following is an explanation of the extrusion die coater in comparison with the gravure roll coater and the reverse roll coater. Although the extrusion die coater does not need a smoothing step necessary in other coaters, the extrusion die coater can coat a more uniform thickness than the others. Further, since the gravure roll coater and the reverse roll coater use the rotating roll whose surface has the coating material, the coating material is scattered by generating centrifugal force at the high rotation speed. One problem with the gravure roll coater is and the reverse roll coater that the coating material scattered in the surrounding air adhere to the coated web again. On the other hand, the extrusion die coater does not have a rotating roll having the coating material. Accordingly, in high speed coating, the extrusion die coater is the best for manufacturing a magnetic film. Recently, the extrusion die coater has been attracting attention as a coater to make a more uniform coating.

However, the above-mentioned conventional configuration of the extrusion die coater has the following problems. The contact pressure between the orifice provided on the end of the die and the a substrate is provided only by the tension of the web. Therefore, if a nonuniformity of tension or a snaking run of the web arises in an running member of the extrusion die coater, a uniform coating on the web is not obtainable When a large amount of coating material is discharged through the orifice, dynamic pressures at the orifice are generated by the effect of the flow in the gap. As a result, the web begins to vibrate at the front of the orifice, and the thickness of the coating film on the web becomes nonuniform. For resolving the above-mentioned problems, there is another conventional extrusion die coater having a backup roll arranged at the rear of the web which faces the orifice. The backup roll supports the web to run on a predetermined position. However, the backup roll is also likely to undesirably vibrate. Therefore, cross wise nonuniformity of coating occurs by changes of the relative distance between the backup roll and the orifice. Furthermore, if debris passes between the backup roll and the orifice, each or both of them are damaged since they are fixed firmly as a rigid body.

OBJECT AND SUMMARY OF THE INVENTION

It is an object of the present invention to provide a coater and method for coating thereby, which makes a uniform coating thickness by keeping a relative distance between a web and an orifice always constant. The coater of the present invention and method for coating prevents damage to an orifice even when debris passes between a web and an orifice.

A coater of an extrusion die coater type in accordance with the present invention comprises a die member having a reservoir for receiving a coating material and a linear orifice at the front end tip to face a web to be coated for discharging the coating material in the reservoir onto the web, and a pad member which is arranged to face the orifice with the web therebetween.

While the novel features of the invention are set forth particularly in the appended claims, the invention, both as to organization and content, will be better understood and appreciated, along with other objects and features thereof, from the following detailed description taken in conjunction with the drawings.

DESCRIPTION OF THE PREFERRED EMBODIMENT

First embodiment

Figure 1:
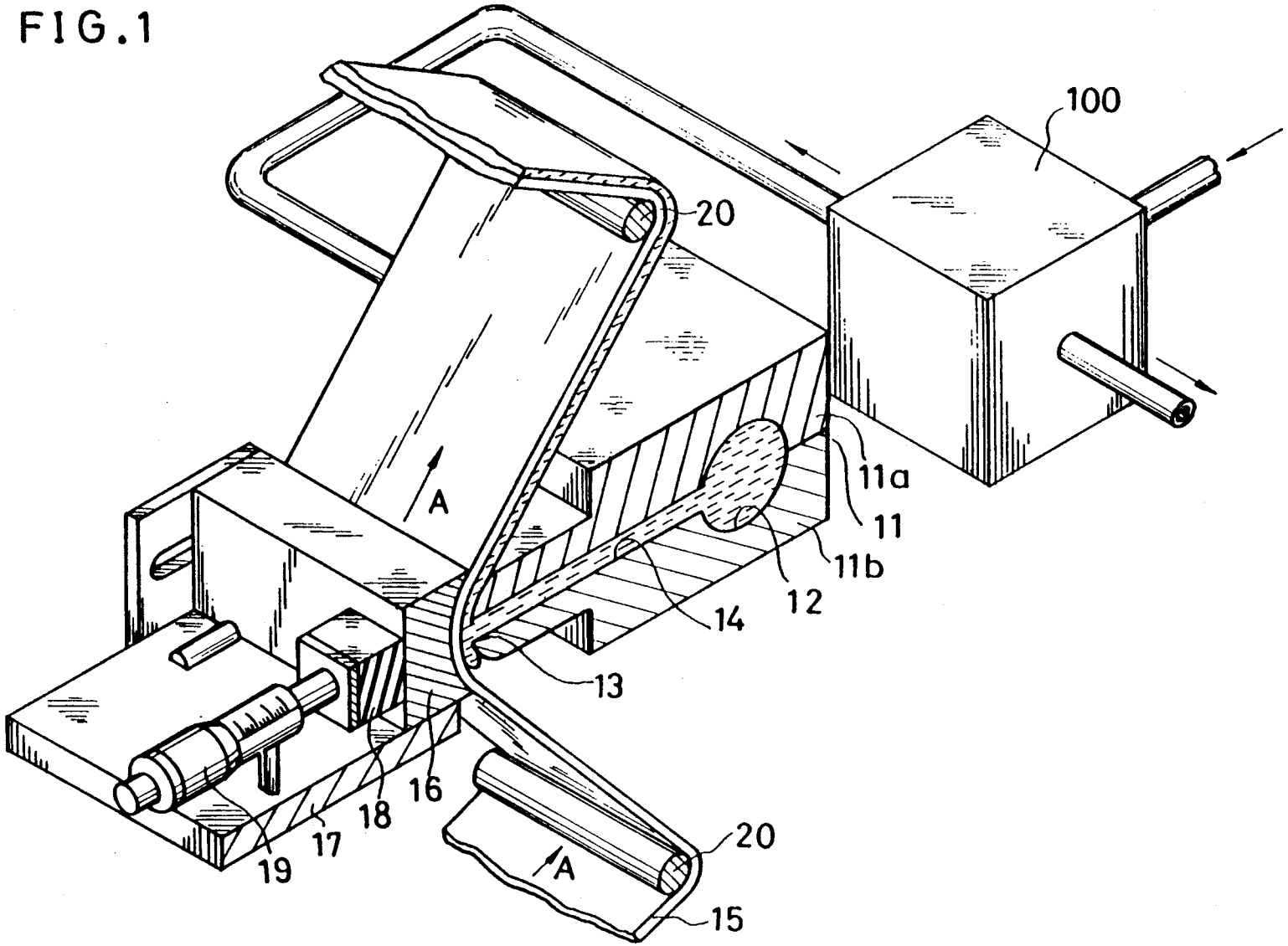
FIG. 1 is a partially sectional view in perspective of a first embodiment of a coater in accordance with the present invention.

FIG. 1 shows a sectional view of a coater of extrusion die type of the present invention. A die member 11 comprises an upper die 11*a* and a lower die 11*b* as shown FIG. 1. A coating reservoir 12 is provided about the center of the die member 11, and is formed substantially into cylindrical form. An orifice 13 of linear shape is provided on the front end of the die member 11. A slotted passage 14 which connects the orifice 13 and the coating reservoir 12 to flow the coating material therein is formed by the pair of die 11*a*, 11*b* having the cavity therebetween. A pad 16 is arranged to face the orifice 13 across a web 15 which is to be coated with the coating material. Also, a face of the orifice 13 facing the web 15 and a face of the pad 16 facing the orifice 13 are formed to have the same curvature. A pad holder 18 which is made of an elastic material such as rubber is arranged on the side opposite the curved face or in the rear side of the pad 16. A pad adjustment member 19 has a mechanism for fine adjustment of the position of the pad 16. An end of the fine adjustment mechanism of the pad adjustment member 19 presses the pad 16 through the pad holder 18 disposed therebetween. Thus, the position of the pad 16 can be moved by the pad adjustment member 19. The pad 16 slides smoothly on a sliding stand 17. The pad 16 is positioned exactly in front of the orifice 13 by the stand 17. The running web 15 is held by rolls 20, arranged above and below the die member 11.

When the new coating material is sent from a supply apparatus 100 having a pump and connected to both sides of the coating reservoir 12, the coating material is discharged from the orifice 13 through the slotted passage 14. The web 15 is run in the direction of the arrow A and is coated with the coating material. At this time, the fluid pressure of the coating material at the orifice 13 is provided by the pressure in the coating reservoir 12. Since the portion of the web 15 which faces the orifice 13 is held by the pad 16, the web 15 runs in the predetermined position defined by the pad 16. Also, the gap between the web 15 and the orifice 13 can be controlled as desired, by the pad adjustment member 19. Therefore, a coating film of the desired thickness can be made by controlling the gap, regardless of the fluctuation or deviation from a set value of pressure in the coating reservoir 12. For the thickness control of the coating film in the order of 0.1 $\mu$m, the thickness is achieved by the pad adjustment member 19 having the mechanism for fine adjustment, for example a micrometermechanism as shown in FIG. 1, or a pulse motor with a rack-and-pinion.

Further, even debris in the coating material is caught between the orifice 13 and the pad 16 across the web 15, the debris is allowed to flow downstream of the web 15, by instant shrinkage of the elastic pad holder 18. Accordingly, the coater of the first embodiment of the present invention can prevent the web 15 from breaking, or the orifice 13 and the pad 16 from sustaining damage. It is preferable to mirror-finish the contact face of the pad 16 against the web 15. It is also preferable that the center of the pad 16 is slightly shifted toward the downstream side from the center of the orifice 13, for achieving a uniform coating.

Second embodiment

In the following, a second embodiment of a coater in accordance with the present invention is elucidated with reference to the drawing of FIG. 2. Corresponding parts and components to the first embodiment are shown by the same numerals and marks, and the description thereon made in the first embodiment similarly apply. The second embodiment is different from the first embodiment in the following points. The coater has plural pads 21*a*, 21*b* which are moved by two pad adjustment members 29*a*, 29*b* independently of one another. Each pad adjustment member 29*a*, 29*b* is operated by fluid pressure. Generally speaking, it is known that a better uniform coating in an extrusion die coaster system can be achieved by forming a pool for coating material at the upstream side of the coating point of a web.

Figure 2:
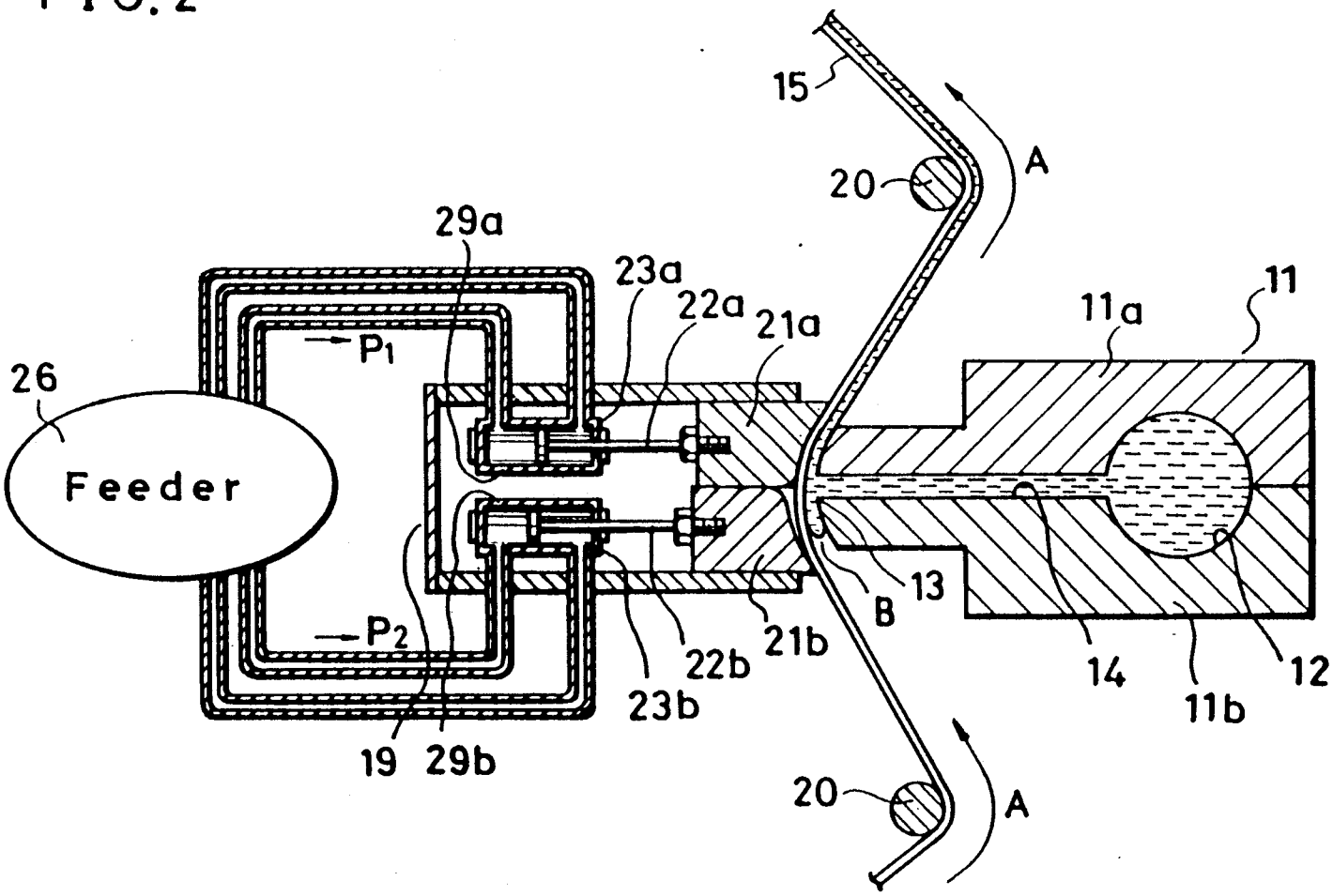
FIG. 2 is a sectional view of a second embodiment of a coater of the present invention.

The second embodiment of the coater in accordance with the present invention adopts the abovementioned pool B in the coating point as shown in FIG. 2. The lower pad 21*b* is slightly offset from the rear face of the web 15 in comparison with the upper pad 21*a*. The degree of offset of the lower pad 21*b* from the upper pad 21*a*, is determined by considering various factors, such as the characteristics of the coating material, pressure of feeding the coating material, web thickness, web speed and other conditions. Since the second embodiment of the coater has the pool B formed between the web 15 and a face of the lower die 11*b*, the coater can make a uniform coating with predetermined thickness. The pad adjustment members 29*a*, 29*b* which operate the upper pad 21*a* and the lower pad 21*b* independently of each other are operated by pressurized fluid, such as oil or air, or by utilizing a pulse motor with a rack-and-pinion. Each pad adjustment member 29*a*, 29*b* comprises the upper piston 22*a* and lower position piston 22*b* connected to the upper pad 21*b*, and lower pad 21*b* respectively. The upper cylinder 23*a* and lower cylinder 23*b* are independently supplied the pressure controlled fluid from a feeder 26. The upper cylinder 23*a* is supplied with a pressure $P_1$ and the lower cylinder 23*b* is supplied with a pressure $P_2$, respectively. Thus, the position control of each pad 21*a*, 21*b* can be controlled by each pressure $P_1$, $P_2$. Also, inserted into the gap between the orifice 13 and the web 15 can be flowed downstream of the web 15 by contracting each pad adjustment member 29*a*, 29*b* with the fluid.

Third embodiment

Figure 3:
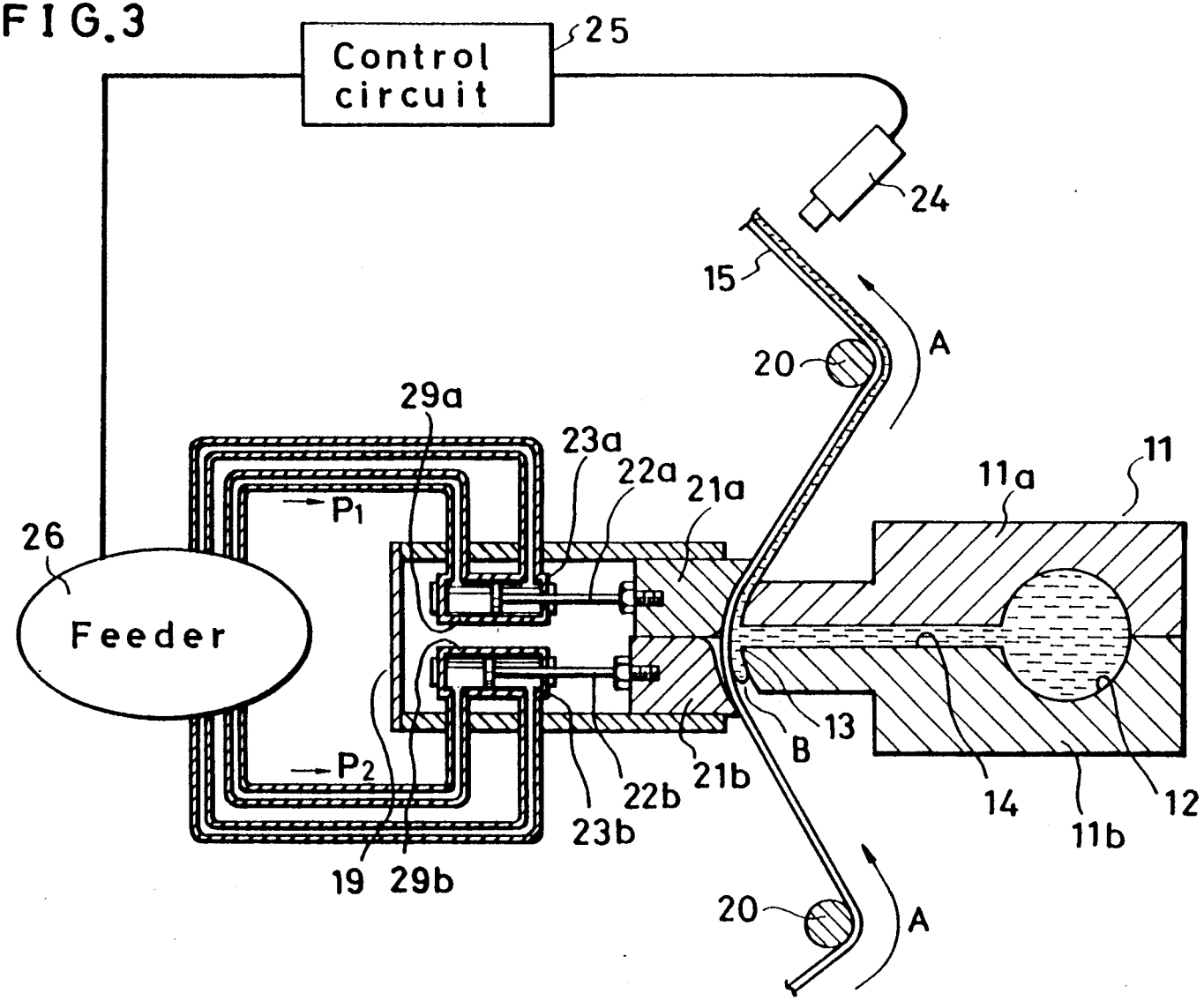
FIG. 3 is a sectional view of a third embodiment of a coater of the present invention.

In the following, a third embodiment of a coater in accordance with the present invention is elucidated with reference to the drawing of FIG. 3. Corresponding parts and components to the first embodiment are shown by the same numerals and marks, and the description thereon made in the first embodiment similarly apply. The third embodiment is different from the first embodiment and the second embodiment in the following points. The thickness of a thin film coated by the aforementioned first or second embodiment of the coater is always measured just after coating by a thickness measuring apparatus 24, for example, an optical sensor of a noncontact thickness gauge, or a thickness monitor of a contact type, or an electromagnetic thickness gauge. Data which is output from the thickness measuring apparatus 24 is passed to a control circuit 25. The control circuit 25 produces a signal in accordance with a deviation between the predetermined data and the measured data. The signal is supplied to a feeder 26 which generates pressure $P_1$, $P_2$ for positioning the pads 21*a*, 21*b*, respectively. Therefore, the third embodiment of the coater is able to provide a uniform film automatically. That is, in long duration continuous mass production, a more uniform thickness of a coating film can be achieved by the coater of the third embodiment of the present invention. The coater is able to respond sensitively even when the viscosity of a coating material changes for a period of time, or when a web speed changes.

Figure 4:
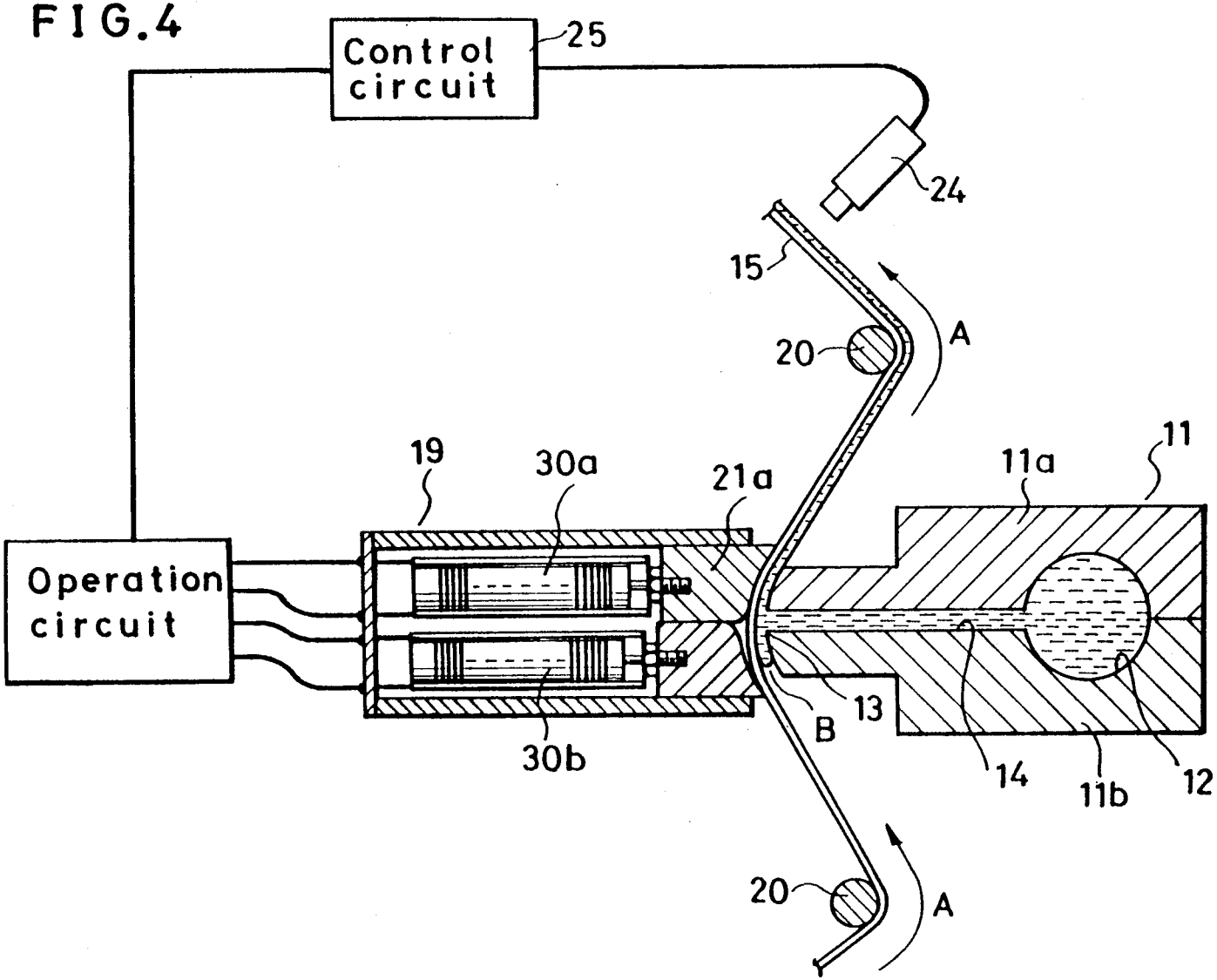
FIG. 4 is a sectional view of another embodiment of a coater of the present invention.

Although the second and the third embodiments of the present invention have been described with on a pad adjustment member of a coater which utilizes compressed fluid for operation, as seen in FIG. 4, transducers 30*a*, 30*b* having laminated piezoelectric elements can be used instead of the mechanism operated by compressed fluid and can provide for further fine adjustment and the making of small components.

Figure 5:
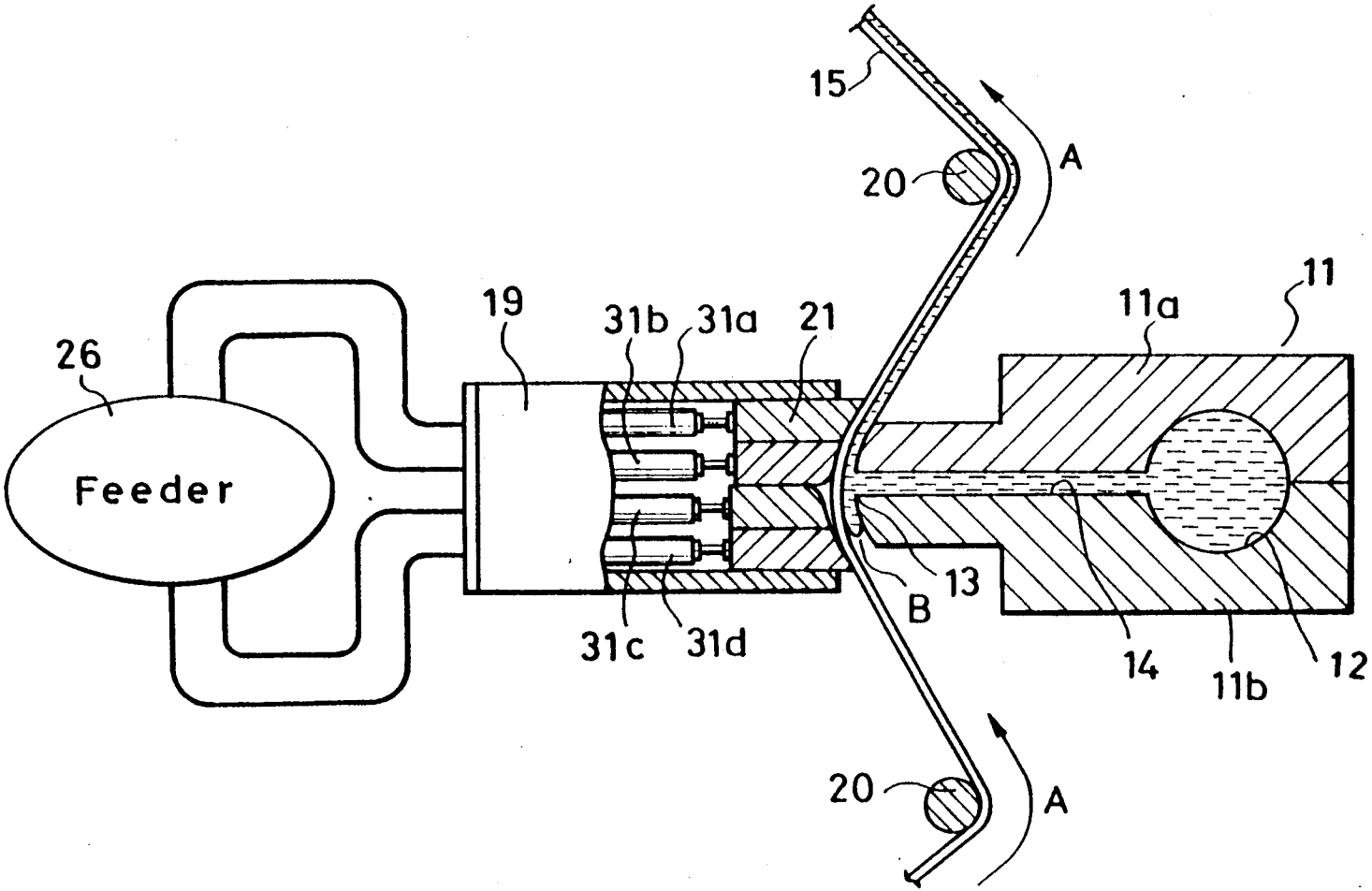
FIG. 5 is a sectional view of another embodiment of a coater of the present invention It will be recognized that some or all of the Figures are schematic representations for purposes of illustration and do not necessarily depict the actual relative sizes or locations of the elements shown.

Although the second and the third embodiments have been described as coaters having two pads 21*a*, 21*b*, more divided pads, for example four pads 31*a*, 31*b*, 31*c*, 31*d* as shown in FIG. 5, can be utilized to control the apparatus more precisely.

Although the invention has been described in its preferred form with a certain degree of particularity, it is understood that the present disclosure of the preferred form can be changed in the details of construction, combination and arrangement of the components without departing from the spirit and the scope of the invention as hereinafter claimed.

What is claimed is:

1. A coater comprising:

a die member having a reservoir for receiving a coating material and a linear orifice at a front end tip facing a web to be coated for discharging said coating material in said reservoir onto said web;

a supply apparatus for feeding said coating material to said reservoir;

a plurality of pads arranged to slide separately, and facing said orifice with said web between said plurality of pads and said orifice;

thickness measuring means for measuring a thickness of a film coated on said web; and control means for moving each pad in accordance with an output of said thickness measuring means.

2. A coater in accordance with claim 1 wherein a face comprising respective faces of said plurality of pads facing said orifice has nearly the same curvature as a face of said orifice facing said web to be coated.

3. A coater as in claim 1, further including a pad adjustment member having a plurality of pad adjustment mechanisms corresponding to the plurality of pads which are independently slidable in a direction toward said die member.

4. A coater in accordance with claim 3 wherein said pad adjustment member comprises:

a plurality of pistons connected to said plurality of pads respectively; and and a pressure supply apparatus for applying a pressure to said plurality of cylinders.

5. A method for coating by a coater, comprising the steps of:

discharging a coating material onto a web from an orifice by supplying a pressure to a reservoir in a die member, measuring a film coated on said web, and independently moving in response to said measuring a plurality of pads facing said orifice with said web between said plurality of pads and said orifice.

6. A method in accordance with claim 5 and further comprising the step of:

providing a pool for uniformly coating said coating material on said web by operating said plurality of pads.

7. A method as in claim 5, including running a web to be inserted between an orifice and said plurality of pads.

* * * * *